US006758310B2

(12) United States Patent
Muff et al.

(10) Patent No.: US 6,758,310 B2
(45) Date of Patent: Jul. 6, 2004

(54) SAFETY BRAKE AND METHOD FOR UNLOCKING A SAFETY BRAKE

(75) Inventors: Josef A. Muff, Hildisrieden (CH); Karsten Gensicke, Buchrain (CH); Reinhard Wöbcke, Buchrain (CH)

(73) Assignee: Inventio AG, Hergiswil (CH)

( * ) Notice: Subject to any disclaimer, the term of this patent is extended or adjusted under 35 U.S.C. 154(b) by 118 days.

(21) Appl. No.: 09/990,050

(22) Filed: Nov. 21, 2001

(65) Prior Publication Data

US 2002/0070082 A1 Jun. 13, 2002

(30) Foreign Application Priority Data

Dec. 7, 2000 (EP) ..... 00811157

(51) Int. Cl.[7] ..... B66B 5/20
(52) U.S. Cl. ..... 187/370; 187/368; 187/375
(58) Field of Search ..... 187/351, 368, 187/370, 375, 356

(56) References Cited

U.S. PATENT DOCUMENTS 6,176,350 B1 * 1/2001 Schlosser ..... 187/375
6,318,507 B1 * 11/2001 Jin ..... 187/376

FOREIGN PATENT DOCUMENTS

| | | |
|---|---|---|
| EP | 0 562 931 | 9/1993 |
| EP | 0 812 796 | 12/1997 |
| EP | 0 999 168 | 5/2000 |
| EP | 1 002 756 | 5/2000 |
| GB | 1 021 552 | 3/1966 |

* cited by examiner

*Primary Examiner*—Eileen D. Lillis
*Assistant Examiner*—Thuy V. Tran
(74) *Attorney, Agent, or Firm*—MacMillan, Sobanski & Todd, LLC

(57) ABSTRACT

A safety brake for the load receiving portion of an elevator includes a fixing device that is displaceable relative to the load receiving portion in the direction of the guide rail between two abutments fastened to the load receiving portion. The unlocking of the safety brake after a braking process is achieved by moving the load receiving portion with the assistance of the elevator drive unit oppositely to the direction of movement before the braking process, so that one of the abutments fastened to the load receiving portion strikes the fixing device to unlock it from the guide rail.

12 Claims, 4 Drawing Sheets

SAFETY BRAKE AND METHOD FOR UNLOCKING A SAFETY BRAKE

BACKGROUND OF THE INVENTION

The present invention relates to a safety brake for a load receiving means of an elevator, with a fixing means which can be brought into a locked and an unlocked state and which in the locked state fixes the load receiving means to a rail, as well as a method for unlocking such a safety brake after a braking process.

Safety brakes are used with a number of different operating principles. A large portion thereof have a clamping mechanism which, after activation by a speed limiter system, produces a clamping action between components of the safety brake and at least one stationary rail, which is mounted parallel to the travel path of the load receiving means, with use of the kinetic energy of the moving load receiving means. Due to self-locking in the clamping mechanism, some of these safety brakes can be unlocked again after the braking process only with considerable expenditure of force.

A safety brake of the kind stated in the foregoing is known from patent document EP 0 899 231 A1 and is explained in more detail in the description below with reference to FIG. 2.

In order to unlock safety brakes, which have a self-locking clamping mechanism, after a braking process, these have to be moved against the movement direction present before the braking process, which usually happens by moving the load receiving means. Such a movement is usually produced by lifting the load receiving means by the drive unit of the elevator or by lowering the load receiving means by the drive unit with utilization of the weight force of the load receiving means and possibly an additional load. For overcoming the mentioned self-locking of the clamping mechanism there is needed a displacement force which is substantially increased by comparison with normal operation. This increased displacement force in many cases exceeds the available force of the drive unit or the weight force of the load receiving means. Unlocking by manipulation at the safety brake is usually not possible, since in the case of braking this is not accessible.

SUMMARY OF THE INVENTION

The present invention has the object of creating equipment by which unlocking of such safety brakes is made possible with substantially reduced release force, i.e. by exclusive use of the unassisted drive unit of the elevator or the weight force of the load receiving means.

The advantages achieved by the invention are essentially that simple and economic safety brakes, which need to overcome substantial frictional forces for unlocking thereof, are usable without the drive units having to apply more than the lifting force required for normal operation and without the load receiving means having to be loaded with additional loads for unlocking after a braking process from an upward movement.

In order, for unlocking the safety brake with the assistance of the abutments movable relative to the fixing means, to be able to exert a blow or impact on these fixing means, these abutments are expediently fixedly connected with the load receiving means so that the blow can be produced by simple vertical movement of the load receiving means.

The fixing means is preferably so connected with the load receiving means that it is displaceable relative to the load receiving means parallel to the stationary rail within a limited displacement path, wherein the abutments form the limitation of this displacement path. For unlocking the safety brake after a braking process the load receiving means can thereby be moved and accelerated over a limited displacement path, without hindrance by the fixing means fixedly seated on the rail, before one of the abutments fixedly connected with the load receiving means collides with this fixing means and unlocks this by a blow utilizing the kinetic energy of the moved load receiving means.

In a further preferred embodiment of the invention at least one of the abutments forming the limitations of the displacement path is adjustable, for example in the manner that the limitation consists of an abutment screw with a fixing nut. The displacement path can thus be optimized in correspondence with the prevailing conditions.

The fixing means is, with advantage, held in normal operation by at least one spring element in contact with the abutment forming the upper limitation of the displacement path and connected with the load receiving means, wherein this spring element has to compensate for at least the weight force of the fixing means. By this measure it is avoided that in the case of a braking process from a downward movement of the load receiving means, in which the greatest braking forces arise, the fixing means firmly clamped to the stationary rail collides against the said upper abutment like a hammer. On unlocking of the safety brake through lifting the load receiving means by the drive unit of the elevator, the load receiving means moves upwards relative to the fixing means, which is fixedly seated on the stationary rail, and against the spring force until an abutment forming the lower limitation of the displacement path collides with the fixing means and thereby helps to unlock the clamping mechanism thereof.

It is advantageous to achieve the limited displaceability of the fixing means relative to the load receiving means in such a manner that the two components are connected together by way of linear guides or pivot guides. Collar screws in guide slots, dovetail or prismatic sliding guides, parallelogram linking lever guides or parallelogram leaf spring guides are suitable forms of embodiment for that purpose.

Displacement paths having a length limited to 5 to 30 mm have proved advantageous for the different conditions of use and variants of safety brakes.

For elevators that have a counterweight and in which a safety brake has to secure the load receiving means even before excess speed in an upward direction it is advantageous to use a fixing means which is effective as a unit in both directions of movement of the load receiving means, wherein different braking forces can be generated for the downward direction and the upward direction. For elevators without a counterweight, fixing means which function only in the downward direction of the load receiving means are sufficient.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
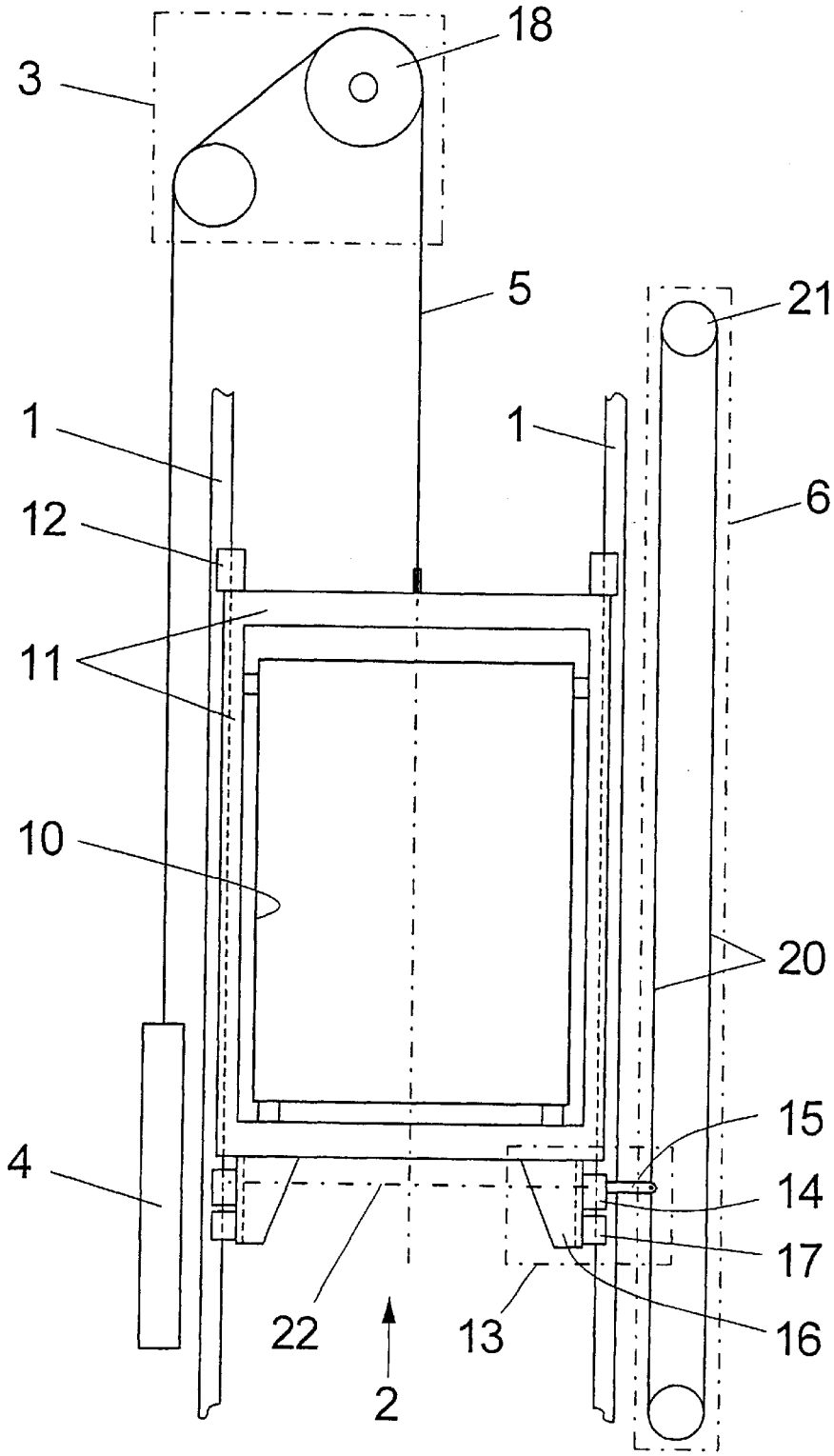
FIG. 1 is a schematic illustration of an elevator with a safety brake according to the present invention.

FIG. 1 shows schematically an elevator installation equipped with a safety brake according to the present invention. This essentially consists of a load receiving means 2 guided in a vertical travel path at guide rails 1, a drive unit 3, a counterweight 4, a number of support cables 5 driven by the drive unit and connected between the load receiving means and the counterweight, and a speed limiter system 6. The load receiving means 2 comprises a car 10 supported by a car frame 11, upper guide shoes 12 and two safety brakes 13 according to the present invention. Such a safety brake 13 is composed of a fixing means 14 and a brake bracket 16, which is connected with the load receiving means 2 and onto which the fixing means 14 is fastened, the bracket 16 additionally carrying two lower guide shoes 17.

The load receiving means 2 and the counterweight 4 are suspended at the support cables 5, which are guided over a drive pulley 18 of the drive unit 3, and are moved back and forth along the guide rails 1 by the drive system formed from these components. In the case of exceeding a speed limit, a speed limiter cable 20, which in the normal case is moved synchronously with the load receiving means 2, is blocked by a speed limiter 21 which by way of a trigger lever 15 activates the fixing means 14, which are connected together by way of a coupling mechanism 22, of the two safety brakes 13. A clamping effect between the fixing means 14 and the guide rails 1 is then produced, with utilization of the kinetic energy of the load receiving means 2, in clamping mechanisms contained in the safety brakes.

Figure 2:
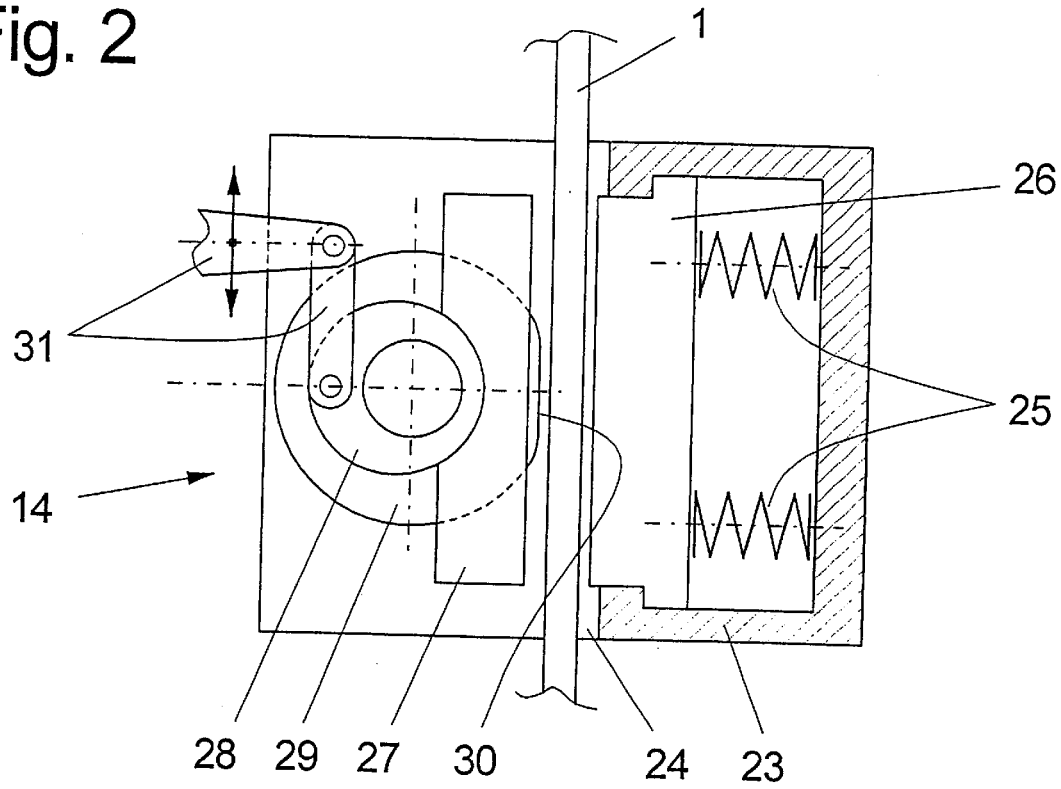
FIG. 2 is a schematic illustration of an embodiment for a fixing means effective in both directions of travel of the load receiving means.

FIG. 2 shows a possible embodiment of the fixing means 14. The guide rail of a load receiving means is denoted by 1. A base body 23 has a cut-out 24, in which the guide rail 1 projects. A first brake shoe 26 supported by biased spring elements 25 is arranged in the base body 23 on one side of the cut-out 24. A second brake shoe 27, which is supported on an eccentric 28 mounted in the base body 23, is present on the other side of the cut-out 24. This eccentric 28 is connected in a rotationally secure manner with a ride-on disc 29, the periphery of which would laterally contact the guide rail 1, but which has at its circumference a flattened location 30 which in the spring-centered normal position of the ride-on disc 29 prevents this contact. A trigger mechanism 31 actuated by way of the trigger lever 15 (FIG. 1) in the case of excess speed by the speed limiter cable 20 causes a rotation of the eccentric 28 together with the ride-on disc 29 to such an extent that the non-flattened part of the periphery of the ride-on disc 29 contacts the guide rail 1. Due to the relative movement between guide rail 1 and the ride-on disc 29, the latter is rotated together with the eccentric 28 until an abutment, which is not illustrated here, stops the rotation, whereupon the ride-on disc 29 is constrained to slide on the guide rail 1. The rotation of the eccentric 28 has the effect that this moves the second brake shoe 27, which is supported thereon, against the guide rail 1 and the latter is clamped between the two brake shoes 26 and 27, wherein the resilient support of the first brake shoe 26 determines the clamping force in dependence on the eccentric stroke. Depending on the direction of movement of the load receiving means 2 present at the instant of triggering, the ride-on disc 29 together with the eccentric 28 is rotated in positive or negative rotational sense. The maximum angles of rotation, which are limited by abutments, are of different size for the positive and the negative rotational sense, whereby different eccentric strokes with correspondingly different clamping and braking forces arise, the forces being adapted to the requirements for braking from downward movement or upward movement.

In order to unlock the self-locking clamping between the fixing means 14 and the guide rail 1 which is present after an instance of braking, this fixing means 14 has to be moved oppositely to the direction of movement of the load receiving means 2 present before the safety braking, which usually takes place by displacing the load receiving means 2 with the assistance of the drive unit 3. In that case the eccentric 28 is rotated by the ride-on disc 29 back into its spring-centered normal position in which clamping forces are no longer produced. The unlocking movement requires a substantial expenditure of force.

Figure 3:
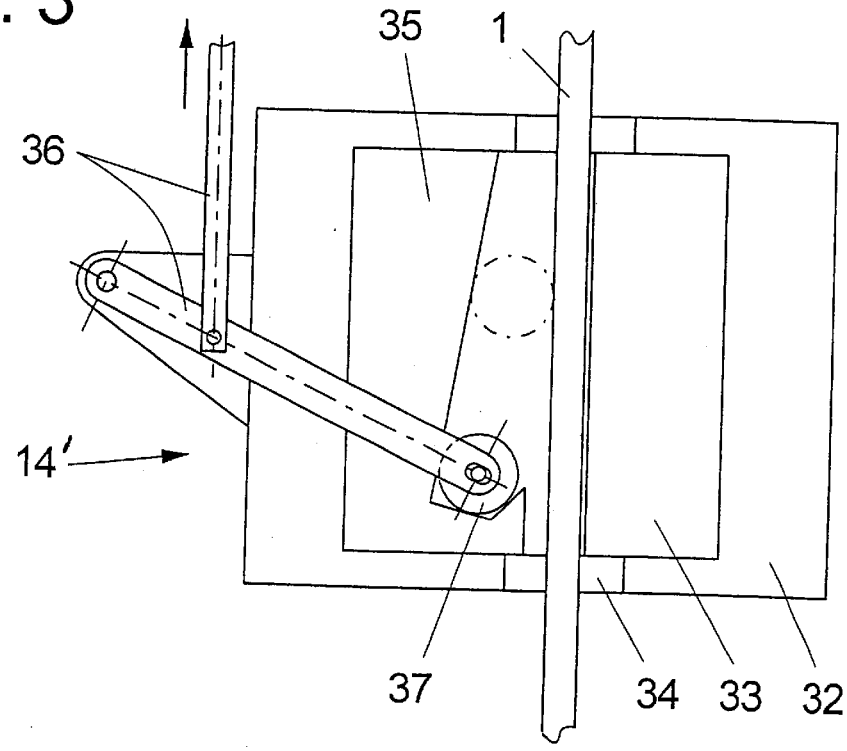
FIG. 3 is a schematic illustration of another embodiment for a fixing means effective only in the downward direction of travel of the load receiving means.

FIG. 3 shows a further possible embodiment of a fixing means 14'. A base body 32 has a cut-out 34 in which the guide rail 1 projects. A block-shaped brake plate 33 is embedded in the base body 32 on one side of the cut-out 34 and the base body 32 includes a clamping ramp 35 on the opposite side. A trigger mechanism 36 connected with the speed limiter cable 20 (FIG. 1) by way of the trigger lever 15 (FIG. 1) carries a cylindrical clamping body 37 arranged in the space between the clamping ramp 35 and the guide rail 1. On triggering of the safety brake, the blocked speed limiter cable has the effect that the trigger mechanism 36 lifts the clamping body 37 and brings it into contact with the guide rail 1 and the clamping ramp 35 moving relative thereto, so that the clamping body 37 is wedged between guide rail 1 and clamping ramp 35 as shown in phantom line. The load receiving means is braked by friction and deforming of the guide rail 1.

In order to unlock the self-locking clamping between this fixing means 14' and the guide rail 1 present after an instance of braking, this fixing means 14' has to be moved oppositely to the direction of movement of the load receiving means 2 present before the safety braking, which is usually carried out by displacing the load receiving means with the assistance of the drive unit. In that case the cylindrical clamping body 37 moves out of the wedging gap, so that clamping forces are no longer present. The unlocking movement requires a substantial expenditure of force.

Figure 4:
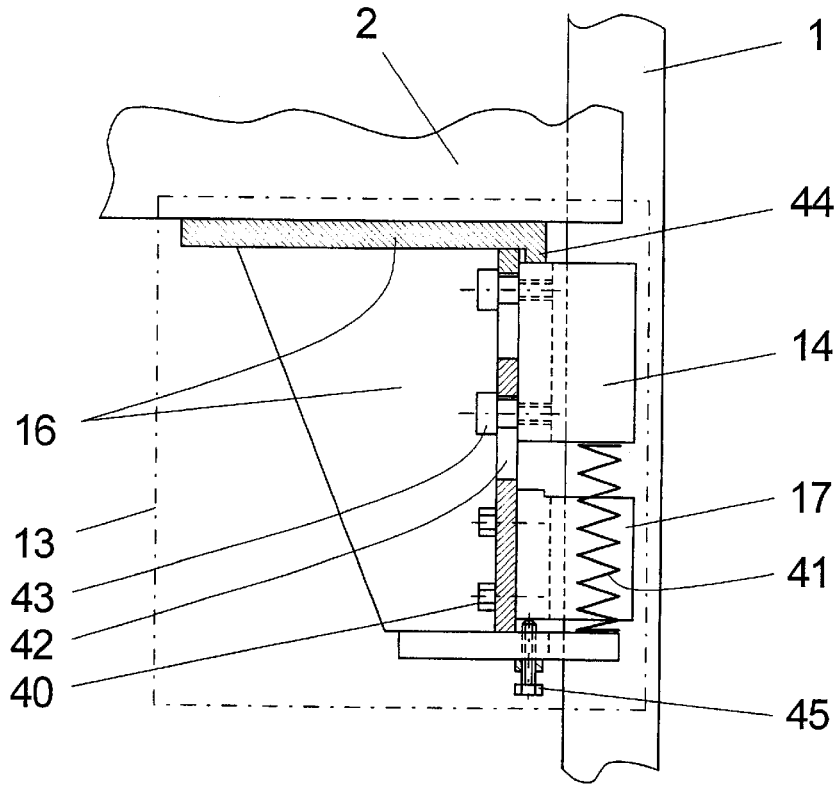
FIG. 4 is a schematic illustration of the safety brake according to the present invention after a braking process from a downward movement of the load receiving means.
Figure 5:
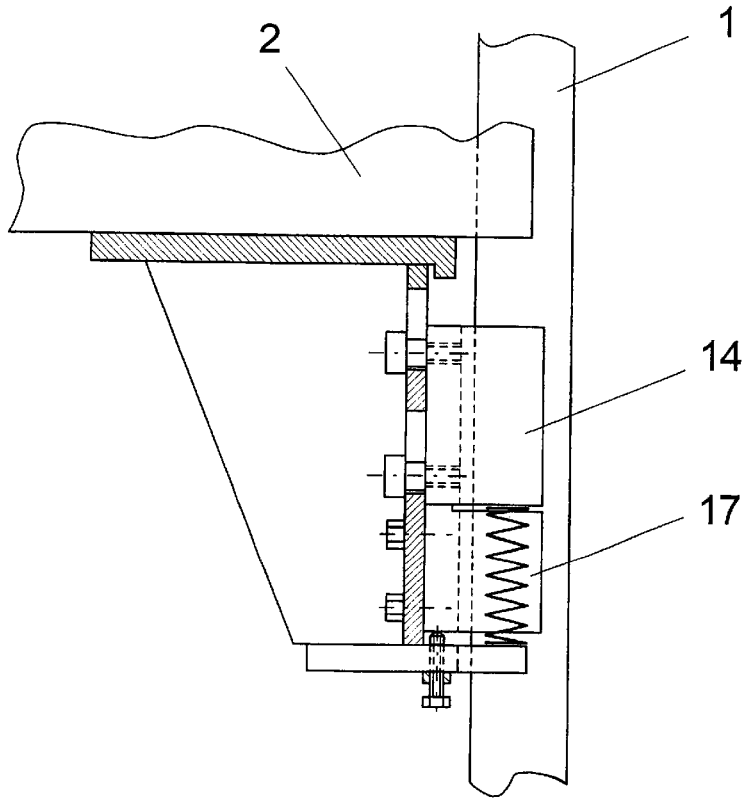
FIG. 5 is similar to FIG. 4 and shows the safety brake at the instant of the unlocking process.

FIG. 4 and FIG. 5 illustrate the mode of operation of the safety brake 13 in accordance with the invention, mounted at a load receiving means 2. The guide rail 1, the fixing means 14, the brake bracket 16, the lower guide shoe 17 and a spring element 41 are shown. The fixing means 14 is fastened to the brake bracket 16 by two collar screws 43, which are guided in slots 42, to be vertically displaceable. An upper abutment 44, which is integrated in the brake bracket 16, and the lower guide shoe 17 limit the displacement travel. Releasable screws 40 and the positioning screw 45 enable setting of an optimal displacement path by moving the lower guide shoe 17 relative to the fixing means 14. In normal operation the spring element 41 keeps the fixing means 14 in contact—against the weight force thereof— with the upper abutment 44. The position of the fixing means 14 after a braking process from a downward movement of the load receiving means is illustrated in FIG. 4, which also corresponds with the position in normal operation. The clamping mechanism, which is fixedly seated on the guide rail 1 by self-locking, of the fixing means 14 is unlocked in the manner that, with the assistance of the drive unit 3 of the elevator, the load receiving means 2 is moved upwardly with the greatest possible acceleration, whereby after a travel path corresponding with the limited displacement path the lower guide shoe 17, which serves as a lower abutment, strikes against the fixing means 14 and, with utilization of the kinetic energy of the entire load receiving means, unlocks the clamping mechanism. FIG. 5 shows the safety brake at the instant of the described impact.

The unlocking action of the safety brake according to the present invention is also given in the case of braking processes from an upward movement of the load receiving means 2. There is used in that case either a double-acting fixing means 14 or two single acting fixing means 14' each associated with a respective direction of movement (FIG. 2 shows an example for a double-acting fixing means and FIG. 3 shows an example for a single-acting fixing means). After triggering of the safety brake due to excess speed of the load receiving means 2 in upward direction, the fixing means 14 firmly clamps against the guide rail 1 in frictional-locking manner and is thereby displaced relative to the brake bracket 16 against the force of the spring element 41 until abutment with the lower guide shoe 17. The fixing means 14 usually remains in this position even after standstill of the load receiving means 2. For unlocking the clamping mechanism, which is fixedly seated at the guide rail 1, of the fixing means 14 the load receiving means 2 together with the brake bracket 16 is lowered with the greatest possible acceleration, which usually takes place with the assistance of the drive unit 3. After a dropping movement of the load receiving means 2 corresponding with the limited displacement path, the upper abutment 44 strikes against the fixing means 14, whereby the self-locking of the clamping mechanism is overcome and this is unlocked.

Figure 6:
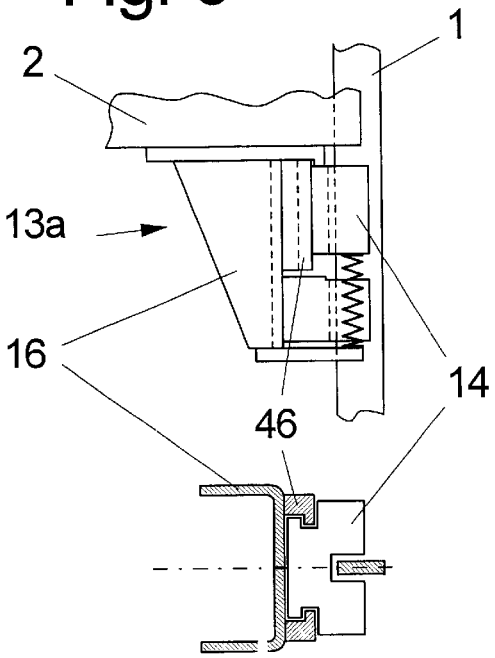
FIGS. 6, 7 and 8 are each a side elevation and top plan view of alternate embodiments of the safety brake with different solutions for realization of the displaceability of the fixing means.
Figure 7:
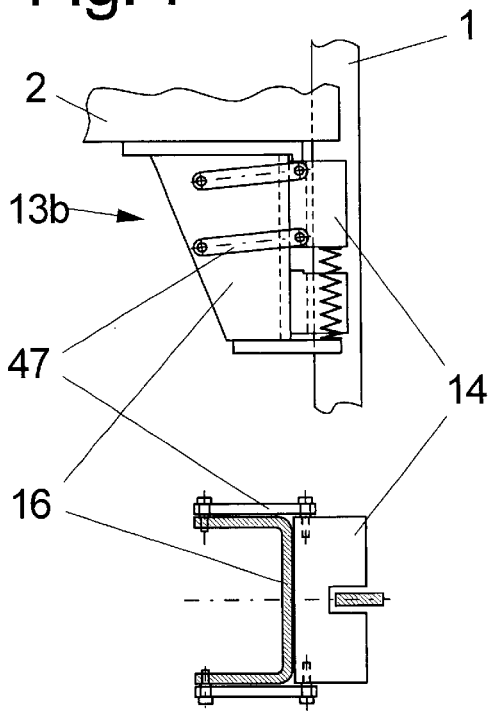
Figure 8:
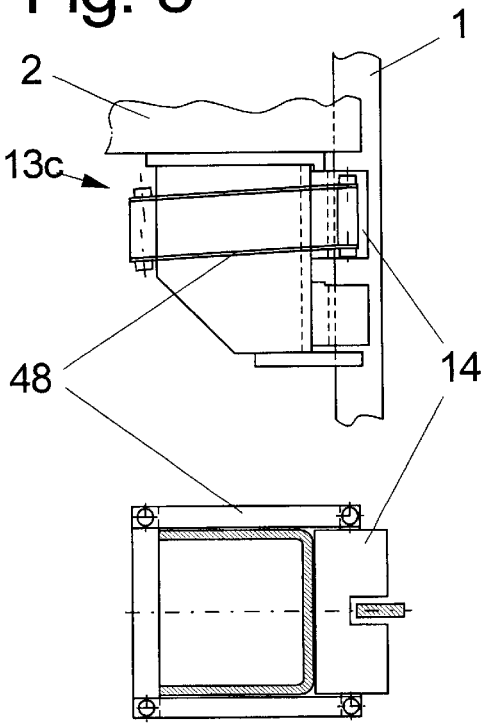

FIGS. 6, 7 and 8 illustrate further embodiments of the safety brake according to the present invention.

In the case of a safety brake 13*a* according to FIG. 6 the vertical displaceability between the fixing means 14 and the brake bracket 16 is achieved in the manner that the two components are connected together by way of a prismatic sliding guide 46. The same effect would also be achieved with a dovetail sliding guide.

FIG. 7 shows a safety brake 13*b* in which the vertical displaceability of the fixing means 14 is achieved in the manner that this is connected with the brake bracket 16 by way of parallel guidance linking levers 47.

A further possible embodiment safety brake 13c is illustrated in FIG. 8, in which the vertical displaceability of the fixing means 14 is achieved in the manner that the latter is connected with the brake bracket 16 by way of parallel guidance leaf springs 48. This solution has the advantage that through upward biasing of the parallel guidance leaf springs 48 the additional spring elements 41 required in the other embodiments can be dispensed with.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A safety brake for a load receiving means of an elevator, the load receiving means being guided for movement along at least one guide rail, comprising: a means for fixing operable between a locked state and an unlocked state and at least one abutment, said means for fixing and said at least one abutment being spaced apart and movable relative to one another, wherein when the safety brake is attached to a load receiving means, said means for fixing fixes the load receiving means to an associated guide rail in said locked state and movement of the load receiving means in a predetermined direction causes said abutment to strike said means for fixing changing said means for fixing from said locked state to said unlocked state to release the load receiving means from the guide rail.

2. The safety brake according to claim 1 wherein said at least one abutment is adapted to be fixedly connected with the load receiving means.

3. The safety brake according to claim 2 wherein said means for fixing is adapted to be coupled with the load receiving means, said means for fixing and said abutment being relatively displaceable within a limited displacement path.

4. The safety brake according to claim 3 wherein said at least one abutment is one of an upper abutment and a lower abutment forming respective upper and lower limitations of said displacement path.

5. The safety brake according to claim 3 including means for adjusting a position of said at least one abutment in the direction of said displacement path relative to said means for fixing.

6. The safety brake according to claim 3 wherein said at least one abutment is an upper abutment forming an upper limitation of said displacement path and including at least one spring element biasing said means for fixing into contact with said upper abutment.

7. The safety brake according to claim 3 including coupling means for movably coupling said means for fixing to a brake bracket adapted to be attached to the load receiving means, said coupling means being one of screws extending through guide slots in said brake bracket, a dovetail sliding guide, a prismatic sliding guide, parallel guidance link levers, and parallel guidance leaf springs.

8. The safety brake according to claim 3 wherein said displacement path is in a range of approximately 5 mm to 30 mm.

9. The safety brake according to claim 1 wherein said means for fixing includes a base body having a cut-out for receiving the rail, a first brake shoe supported by spring elements and an opposing second brake shoe supported on an eccentric mounted on said base body, said eccentric being connected in a rotationally fast manner with a ride-on disc having a flattened location at a periphery thereof, whereupon activation of the safety brake causes said ride-on disc connected with said eccentric to rotate about its axis by a trigger mechanism such that a non-flattened part of said periphery presses against the rail, and wherein in consequence of relative movement between the rail and said ride-on disc the latter is further rotated together with said eccentric until a stop to rotation occurs, so that said eccentric moves said second brake shoe supported thereon against the rail and the latter is clamped between said first and second brake shoes.

10. The safety brake according to claim 1 wherein said means for fixing includes a base body having a cut-out for receiving the rail, a brake plate opposed by a clamping ramp extending at an inclination relative to the rail, and a trigger mechanism attached to a clamping body engaging said clamping ramp, and wherein upon activation of the safety brake by a speed limiter system connected to said trigger mechanism, said clamping body is guided between the rail and said clamping ramp becoming wedged therebetween.

11. A safety brake for a load receiving means of an elevator, the load receiving means being guided for movement along at least one guide rail, comprising: a means for fixing operable between a locked state and an unlocked state, said means for fixing being positioned between an upper abutment and a lower abutment, said abutments being fixed relative to one another and movable relative to said means for fixing, wherein when said means for fixing is attached to a load receiving means, said means for fixing fixes the load receiving means to an associated guide rail in said locked state, and wherein movement of the load receiving means in a downward direction causes said upper abutment to strike against said means for fixing and movement of the load receiving means in an upward direction causes said lower abutment to strike against said means for fixing, said means for fixing being responsive to said striking to change from said locked state to said unlocked state.

12. A method for unlocking a safety brake for a load receiving means of vertical conveying equipment after a braking process comprising the steps of:

a. providing a means for fixing connected with the load receiving means and displaceable relative to the load receiving means within a limited displacement path, the means for fixing being in a locked state fixed to a guide rail as a result of the braking process;

b. providing a pair of abutments fixedly connected with the load receiving means and forming end limits of the displacement path; and c. moving the load receiving means opposite to a movement direction before the braking process until one of the abutments strikes against the means for fixing to change the means for fixing to an unlocked state.

* * * * *